United States Patent [19]

Molitor et al.

[11] 4,011,802

[45] Mar. 15, 1977

[54] MAKEUP AIR DEVICE FOR GREASE EXTRACTION VENTILATOR

[75] Inventors: Victor D. Molitor, Denver; Arlen W. Gallagher, Arvada, both of Colo.

[73] Assignee: Stainless Equipment Company, Englewood, Colo.

[22] Filed: Jan. 27, 1975

[21] Appl. No.: 544,138

[52] U.S. Cl. ..... 98/115 K; 55/223; 55/244; 55/DIG. 36; 126/299 B

[51] Int. Cl.[2] ..... F23J 11/02

[58] Field of Search ..... 98/115 K, 115 R, 40 N, 98/36; 126/299 R, 299 B; 55/DIG. 36, DIG. 29, 223, 244

[56] References Cited

UNITED STATES PATENTS

| | | | |
|---|---|---|---|
| 3,292,525 | 12/1966 | Jensen | 98/115 K |
| 3,457,850 | 7/1969 | Sweet et al. | 98/115 K |
| 3,645,194 | 2/1972 | Ahlrich | 98/115 K |
| 3,664,255 | 5/1972 | Kuechler | 98/115 K |
| 3,773,000 | 11/1973 | Applegate | 98/36 |

*Primary Examiner*—Ronald C. Capossela
*Attorney, Agent, or Firm*—Horace B. Van Valkenburgh; Frank C. Lowe

[57] ABSTRACT

The makeup air device includes a front chamber, a lower wall of which is adapted to force rising smoke and the like into an intake of a grease extraction ventilator. A depending passage at the lower front of the device has an air outlet which discharges air toward the ventilator intake. An adjustment baffle having a forwardly slanted lower flange is moved in the outlet between a position of maximum flow and a position of no flow. Louvers in the front wall of the chamber above the passage are adjustable, so that different amounts of fresh air may flow into the room in which the cooking equipment is placed.

6 Claims, 7 Drawing Figures

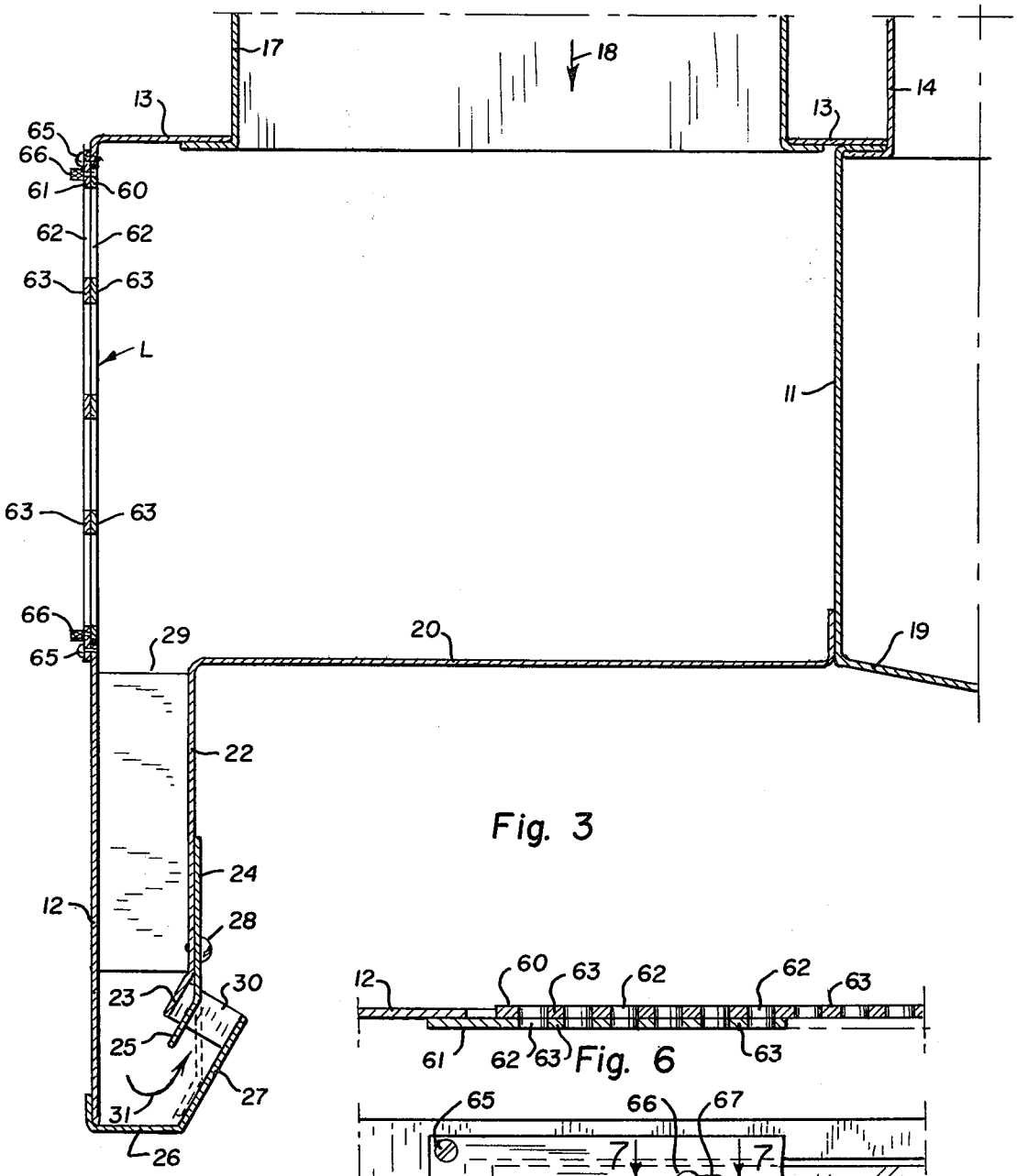
Fig. 3
Fig. 6
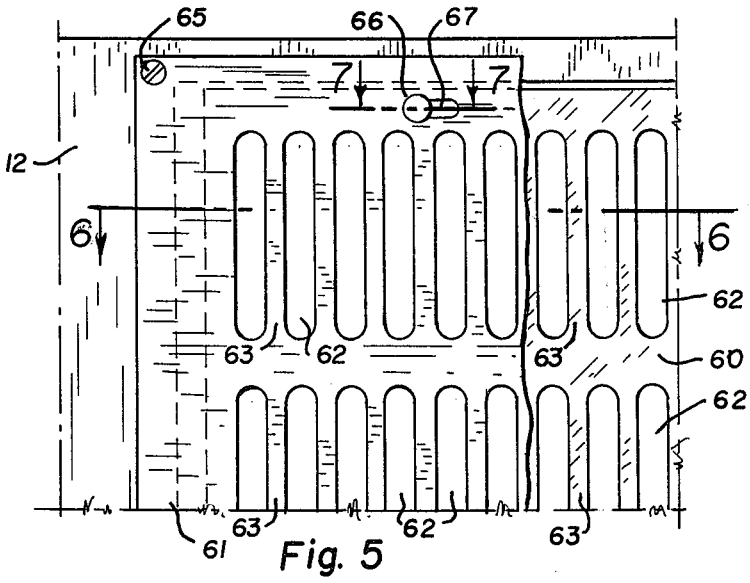
Fig. 5
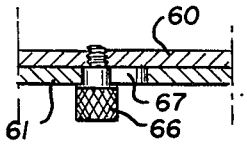
Fig. 7

MAKEUP AIR DEVICE FOR GREASE EXTRACTION VENTILATOR

This invention relates to makeup air devices for grease extraction ventilators. The device of this invention is particularly adapted to be utilized with the grease extraction ventilator of our U.S. Pat. No. 3,841,062 issued Oct. 15, 1974.

Grease extraction ventilators are utilized for removing smoke or grease particles, fumes and the like from cooking equipment, such as stoves, ranges, broilers and the like. The grease extraction ventilator of the above patent prevents the accumulation of grease in the ventilator and extracts the grease without permitting greasy vapors and similar contaminents to escape through the flue into the outside air. Since the suction effect of the ventilator must be sufficient for the maximum production of smoke, grease and the like, a desired removal rate of such a grease extraction ventilator results in air being removed from the room, along with the smoke, fumes and the like. Thus, it is desirable to provide makeup air for the room in which the grease extraction ventilator is installed above cooking equipment. For portions of the cooking equipment in which smoke, fumes and the like are at a minimum, the suction of the ventilator removes an unnecessarily large amount of air from the room, so that makeup air supplied directly to the ventilator will reduce the amount of air otherwise drawn from the room. However, for cooking equipment which produces a maximum of smoke and the like, it is desirable that the grease extraction ventilator pull all of the smoke and the like into the ventilator, so that additional makeup air for that pulled from the room is desirable, but it should be supplied directly into the room, rather than to the ventilator. Thus, it is evident that a makeup air device for a grease extraction ventilator should be adjustable for each type of cooking equipment, to furnish regulated portions of makeup air to the ventilator itself or to the room in which installed.

Among the objects of this invention are to provide a novel makeup air device for use with grease extraction ventilators; to provide such a device which will supply makeup air to a grease extraction ventilator at an area in which an unnecessary amount of air may otherwise be withdrawn from the room; to provide such a device which may be adjusted to provide different amounts of makeup air to the ventilator at different positions; to provide such a device which will supply makeup air to the room in which the cooking equipment is located; to provide such a device which may be adjusted to vary the amount of makeup air discharged to the ventilator or into the room at various positions; and to provide such a device which is relatively simple in construction, yet effficient and effective in operation.

The foregoing and additional objects, as well as the advantages and novel features of this invention, will become apparent from the description which follows, taken in conjunction with the accompanying drawings, in which:

FIG. 3 is an enlargement of the portion of FIG. 2 showing the makeup air device.

FIG. 5 is a fragmentary front elevation, on an enlarged scale, of a pair of adjustment or louver plates utilized in adjusting the amount of makeup air discharged into the room itself.

FIG. 6 is a fragmentary horizontal section taken along line 6—6 of FIG. 5, with the louvers adjusted to a different position.

FIG. 7 is a fragmentary section, on an enlarged scale, taken along line 7—7 of FIG. 5.

Figure 1:
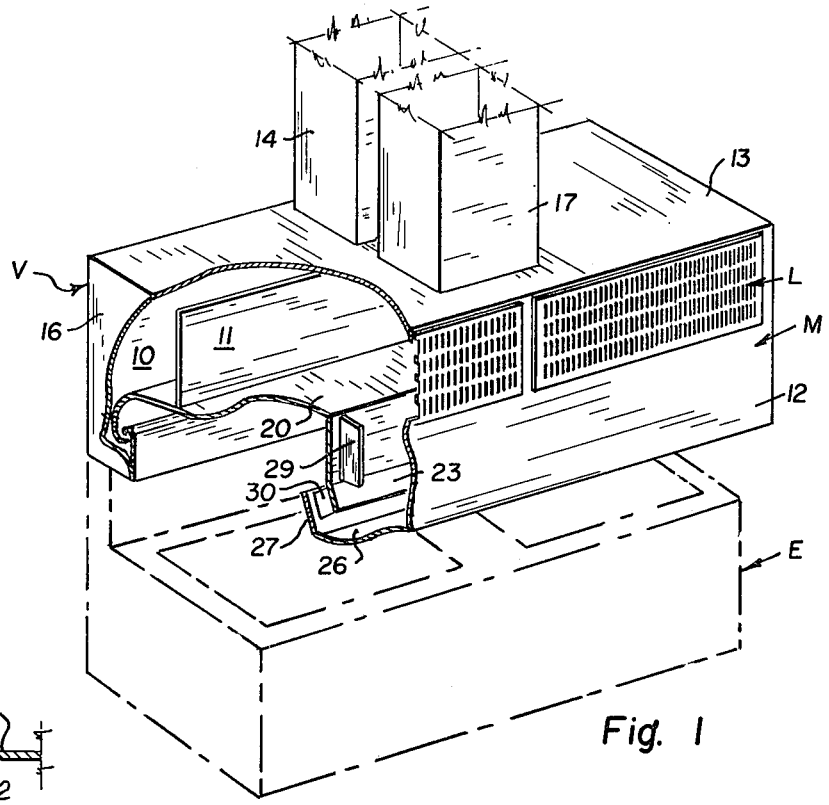
FIG. 1 is a perspective view, partially broken away to show the interior construction of a grease extraction ventilator and an associated makeup air device mounted above the stove, broiler or other cooking equipment shown in dot-dash lines.

As shown in FIG. 1, a grease extraction ventilator V, constructed in accordance with the aforesaid U.S. Pat. No. 3,841,062, may be mounted above cooking equipment E, which may include one or more of a range, stove, broiler or the like, or a series of the same, with the side to side width of the ventilator corresponding to the width of the cooking equipment. As will be understood, the ventilator V and makeup air device M, as well as the cooking equipment E, may be considerably more elongated than is shown.

Ventilator V includes a rear wall 10 and a front wall 11, which also forms the back wall of the makeup air device M, the latter having a front wall 12. Connecting with the common top wall 13 of the ventilator and makeup air device, between the walls 10 and 11, is a duct 14 which extends to a conventional flue or the like, and in which flue is installed an appropriate fan for producing sufficient suction, in the direction of arrow 15, within the ventilator V to pull the smoke and the like from the cooking equipment area. The makeup device M and ventilator V also share common side walls 16. A second duct 17 conveys outside air in the direction of arrow 18 into a plenum chamber between the rear wall 11 and front wall 12 of the makeup air device M, a blower or fan being installed at an appropriate position in the duct which normally extends to outside air.

The ventilator V is provided with a plate 19 extending rearwardly from the lower end of wall 11, while device M is provided with a plate 20 extending forwardly from the lower end of wall 11. The plate 20 terminates at a position spaced from the front wall 12 of the makeup device, while a rear wall 22 of an air supply passage of the makeup device extends downwardly from the end of plate 20 in spaced relation to the front wall 12, terminating in a forwardly and downwardly extended lip 23, as at an angle of 30° to the vertical. Adjustably mounted on and in depending position from the plate 20 is a vertically adjustable baffle 24 provided with a forwardly slanted lower flange 25 inclined at the same angle as lip 23. At the lower edge of front wall 12, a bottom wall 26 extends rearwardly and is connected to or integral with an upturned flange 27 which corresponds generally in inclination but may be greater in size than the flange 25 of baffle 24.

Figure 2:
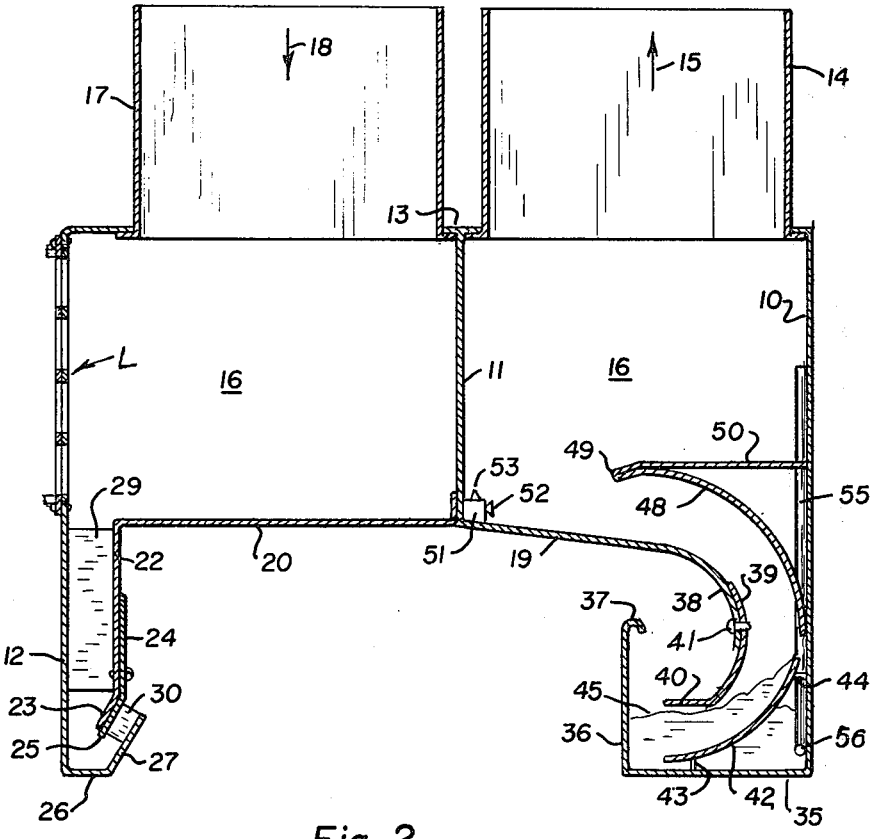
FIG. 2 is a central vertical cross section of the ventilator and makeup air device of FIG. 1 on an enlarged scale.

Baffle flange 25 may be adjusted upwardly and downwardly, being held in adjusted position by screws 28 at vertical slots of the baffle 24, between a position in which flange 25 engages lip 23, as in FIG. 2, and a position in which the flange 25 is spaced from flange 27, as shown in full in FIG. 3. The lower edge of flange 25 may also engage bottom wall 26, as in the dotted position of FIG. 3, to eliminate makeup air flow for the length of the baffle 24. Ordinarily, a ventilator and makeup air device will be used with several types of cooking equipment, with a series of baffles plates 24 installed in side by side relation and in convenient widths, as on the order of 30 inches and 36 inches to correspond in total width to the width of the ventilator. A series of reinforcing plates 29 extend across the passage, while a spacer 30 extends between fixed lip 23 and angular flange 27, at the edges of adjacent baffle plates 24. Air which is permitted to flow will move around the lower edge of flange 25, in the direction of arrow 31.

As in the aforesaid U.S. Pat. No. 3,841,062, the ventilator includes a water bath compartment bounded at the rear by a lower portion of back wall 10, at the bottom by a bottom wall 35 and at the front by a front plate 36 having an inward curl 37 along its upper edge. Lower plate 19 extends downwardly and rearwardly into a downwardly extending, arcuate curl 38 to which is secured an arcuate baffle 39 having a planar segment 40 and adjustable in position through screws 41. The baffle 39 may be adjusted for the optimum position, to cause the air, smoke and the like moving around the segment 40 to impinge against the water and drive it rearwardly and upwardly against a curved plate 42 which is attached to the bottom wall 35 by a series of legs 43 and to the rear wall 10 by a series of legs 44. As in the aforesaid patent, the impingement of the air, smoke and the like against the water will drive it upwardly and rearwardly against plate 42, so that the upper edge of the water will correspond generally to a line 45. The water is also churned to produce numerous tongues of water to intercept the stream of smoke and air and separate out grease particles and the like. The upper legs 44 assure that the plate 42 will be spaced from the rear wall 10, so that the water bearing grease and the like may be driven over the upper edge of the plate to fall behind it, while the spacing of the front edge of plate 42 from the bottom wall 35, through the legs 43, insures that the water before and behind plate 42 will seek a common level, when the suction through duct 14 is discontinued.

The air carrying smoke and the like, which is pulled by suction through the space above curl 37, together with any air which may be blown into the space beneath plate 19 by the air makeup device will intermingle with the air carrying products of cooking. After passage through the water chamber, the air and remaining gases will pass upwardly through the passage between the arcuate baffle 39 and generally parallel arcuate baffle 48 above it. This stream of air and gases then passes sharply around the planar edge 49 of baffle 48 into a plenum chamber between walls 10 and 11. Then, due to the change in direction of the air stream, droplets of water carrying dissolved smoke or other products of cooking can be thrown out and onto the top of plate 19. A horizontal plate 50 extends from the rear wall 10 to the front end of plate 48, to support the same in the desired position. The remaining air is sucked upwardly through duct 14 in the direction of arrow 15.

The cleaning of the ventilator V is preferably accomplished through a timing clock arrangement set to clean the ventilator at predetermined times, such as every 8 hours. Thus, the clock will cause a pump to be energized to supply a detergent to a hot water rinse tube 51 having a series of horizontal nozzles 52 adapted to discharge a solid cone spray in a horizontal plane and also a pair of vertical nozzles 53 beneath the position of a pair of fuse links (not shown) below the duct connection 14. The detergent is injected into tube 51, as for 30 seconds, until the tube carries on the order of 9½ to 10 oz. of detergent. Through a solenoid valve, as for a period of 90 seconds, the water bath is flushed from each end, toward the overflow connection at the center, through a vertical pipe 55 at each end and having a smaller pipe 56 attached to its lower end to serve as a nozzle and directed toward the center of the water bath. Hot water, through nozzle pipe 56, assists in carrying any floating grease to the center outlet. The fan is then turned off and another solenoid valve is actuated to supply hot water to tube 57 for a suitable period, such as 90 seconds, so that the detergent is first sprayed out onto the inside of wall 10, the top of plate 19 and the underside of arcuate baffle 48. Hot water will be sprayed onto the same area and will also be deflected onto the rear of wall 11, on the top of plate 19 and against arcuate baffle 39. As will be evident, the hot water so directed, carrying with it the results of cleaning by the detergent, will flow downwardly into the water bath below, with any excess water being drained off, as in a manner described in the aforesaid patent.

It is contemplated that a series of baffles 25, each having a width of 30 inches or 36 inches, depending on the width of the ventilator, will be provided. Thus, the volume of makeup air, indicated by arrow 31, is adjusted to conform to the requirements of the cooking equipment immediately below. Thus, for cooking equipment requiring a minimum amount of smoke or the like to be removed, the amount of makeup air may be increased, since it is unnecessary, to take care of the cooking equipment, to remove any additional air from the room. However, for an extremely smoky operation, such as steak broiling, it may be necessary to cut down the makeup air to zero, in order to provide sufficient suction and volume of air and smoke to keep the area immediately adjacent to the cooking equipment as free of smoke and the like as possible.

In addition to supplying makeup air to a grease extraction ventilator, the makeup air device of this invention may also be utilized to supply makeup air to the room in which the cooking equipment is installed, in order to compensate for that air which is sucked up through the ventilator, along with the smoke and other products of cooking. For this purpose, the device M is provided with a louver construction L, extending across the front wall 12, above the position of plate 20 and including a series of adjustable inner plates 60 and fixed outer plates 61 above each baffle 24. Each plate 60 and 61 is provided with several rows of slots 62 and spaces 63 between the slots, with both the rows and the slots in each row being spaced apart. The slot spacing 63 is conveniently equal to the width of slots 62, so that movement of the inner plate 60 from a position in which the slots coincide and the maximum amount of air flows through, to a closed position in which no air flows, requires an adjustment of the inner plate 60 a distance equal to the slot width. This may be on the order of ¼ inch.

Each fixed plate 61 may be removably attached to front wall 12 by four or more sheet metal screws 65, as at the corners thereof above and below the rows of slots. Each adjustable plate is held against a fixed plate 61 by four or more thumb screws 66 threadedly engaging a tapped hole in the adjustable plate 60 and extending through a slot 67 in the fixed plate 61. As will be evident, the length of slot 67 corresponds to the total amount of movement of the adjustable plate between fully open and fully closed positions of the slots.

Figure 4:
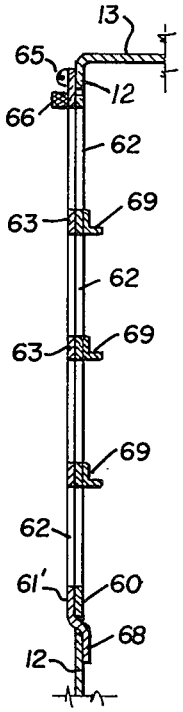
FIG. 4 is a fragmentary vertical section corresponding to a portion of FIG. 3, but showing an alternative construction.

In the alternative construction of FIG. 4, the adjustable plate 60 is unchanged, while a fixed plate 61' is attached adjacent its upper edge to wall 12 by sheet metal screws 65, as before, but the lower edge is provided with an inset flange 68 which overhangs into the opening in wall 12 which receives the adjustable plate but is deepened, if necessary, sufficiently to receive the plate 61'. Thumb screws 66 and slots for adjustable attachment of the plate 60 to plate 61', as described previously, may be utilized. However, the adjustable plate may be stiffened by a series of transverse angles 69 attached, as by spot welding, to the solid areas between rows of slots. One advantage of the inset flange 68 is that it stiffens the plate 60. The horizontal flanges of angles 69 may extend into the chamber between walls 11 and 12 in order to direct air in a desired direction, such as upwardly into the room.

The combination of a ventilator having an intake and an adjustment for incoming smoke, air and the like with a makeup air device having an outlet for directing air toward the ventilator intake, as well as an adjustment for such air and also a set of louvers or the like adjustable for varying the amount of air discharged into the room, enables the optimum adjustment to be made to save energy. Thus, the baffle 39 of the ventilator may be adjusted to provide the minimum movement necessary to remove smoke and the like. Next, the baffle flange 25 of the ventilator may be adjusted to furnish a maximum amount of makeup air without turbulence. It will be noted that the air supplied through the makeup air device need not be tempered and thus does not require as much energy for circulation. The makeup air, during most of the year, will normally be cooler than the air above the cooking equipment and thus will tend to cool the mixture of air and smoke, fumes and the like, entering the ventilator, thereby causing more grease to solidify and enhancing the operation of the evaporator. The louvers L supply makeup air to the room which compensates for the room air sucked into the evaporator, particularly at sections of maximum volume of air and smoke and the like required by the ventilator.

Although a preferred embodiment of this invention has been illustrated and described and certain variations thereof indicated, it will be understood that other embodiments may exist and that various changes may be made without departing from the spirit and scope of this invention.

What is claimed is:

1. The combination of a makeup air device and a grease extraction ventilator, wherein:

said ventilator is provided with an intake and means for adjusting the amount of air and smoke, grease and the like to flow through said ventilator;

said ventilator includes a water bath chamber having a front wall with said intake above said front wall;

a plate forms the lower boundary of a chamber for flow of the air and products passing through said water bath, the underside of said plate forming the upper boundary of said intake;

said makeup air device includes an air chamber adjacent said ventilator, a passage from said chamber leading to an outlet adapted to direct air toward said intake and means for adjusting the amount of air to be directed toward said intake;

said makeup air chamber having a bottom wall adjoining said boundary plate and said passage extending downwardly from said air chamber to said outlet; and said outlet having upwardly inclined walls for directing air towards said bottom wall of said makeup air chamber for flow past and along the underside of said boundary plate to said intake.

2. The combination of a makeup air device and a grease extraction ventilator as set forth in claim 1, wherein:

said device and ventilator are located in a room;

said air chamber of said device is provided with an outlet in a wall opposite said ventilator for discharging air from said makeup air chamber into said room; and said device is provided with adjustable means for regulating the amount of air discharged into said room through said outlet.

3. The combination of a makeup air device and a grease extraction ventilator as set forth in claim 2, wherein:

said means for regulating the air discharged from said outlet into said room includes a series of pivoted louvers extending across said outlet.

4. The combination of a makeup air device and a grease extraction ventilator as set forth in claim 1, wherein:

said means for adjusting the amount of air to be directed toward said intake includes a series of upwardly and downwardly movable baffles adjustably connected to the wall of said passage facing said ventilator intake, said baffles having at their lower ends flanges extending into said outlet and parallel to the walls thereof.

5. The combination of a makeup air device and a grease extraction ventilator as set forth in claim 4, wherein:

a series of plates extend across said passage at positions corresponding to the edges of adjacent baffles.

6. The combination of a makeup air device and a grease extraction ventilator as set forth in claim 1, wherein:

said device and ventilator are located in a room; and said device is provided with means for supplying makeup air into said room through an outlet discharging said makeup air in a direction away from said ventilator.

* * * * *